US012605032B2

(12) United States Patent
Kokoska et al.

(10) Patent No.: US 12,605,032 B2
(45) Date of Patent: Apr. 21, 2026

(54) DISHWASHER WITH A HOUSING

(71) Applicant: WHIRLPOOL CORPORATION, Benton Harbor, MI (US)

(72) Inventors: Scott Patrick Kokoska, South Bend, IN (US); Varun Dattatray Kuvalekar, Maharashtra (IN); Rafal Serniak, Zmigrod (PL)

(73) Assignee: Whirlpool Corporation, Benton Harbor, MI (US)

( * ) Notice: Subject to any disclaimer, the term of this patent is extended or adjusted under 35 U.S.C. 154(b) by 232 days.

(21) Appl. No.: 18/519,719

(22) Filed: Nov. 27, 2023

(65) Prior Publication Data

US 2024/0215795 A1 Jul. 4, 2024

Related U.S. Application Data

(60) Provisional application No. 63/435,595, filed on Dec. 28, 2022.

(51) Int. Cl.
*A47L 15/42* (2006.01)

(52) U.S. Cl.
CPC ..... *A47L 15/4274* (2013.01); *A47L 15/4259* (2013.01)

(58) Field of Classification Search
None
See application file for complete search history.

(56) References Cited

U.S. PATENT DOCUMENTS

| | | | | |
|---|---|---|---|---|
| 6,200,155 | B1 | 3/2001 | Chudkosky et al. | |
| 2024/0057844 | A1* | 2/2024 | Bhat | A47L 15/421 |

FOREIGN PATENT DOCUMENTS

| | | | |
|---|---|---|---|
| EP | 0382999 | A2 | 8/1990 |
| EP | 2625997 | A1 | 8/2013 |
| EP | 3965632 | A0 | 11/2020 |
| GB | 2387043 | A | 10/2003 |

* cited by examiner

*Primary Examiner* — Rita P Adhlakha
(74) *Attorney, Agent, or Firm* — McGarry Bair PC

(57) ABSTRACT

A dishwasher includes a chassis defining an interior. A tub is located within the interior and at least partially defines a treating chamber. The dishwasher further includes an electrical power bus having a plug. An appliance socket receives the plug from the electrical power bus. The dishwasher further yet includes a radio frequency interference (RFI) housing.

20 Claims, 7 Drawing Sheets

DISHWASHER WITH A HOUSING

CROSS-REFERENCE TO RELATED APPLICATION

This application claims the benefit of U.S. Application 63/435,595, filed Dec. 28, 2022, which is incorporated herein in its entirety.

BACKGROUND

Contemporary automatic dish treating appliances for use in a typical household include a cabinet with an access opening and a tub that can have an open front and at least partially defines a treating chamber into which items, such as kitchenware, glassware, and the like, can be placed to undergo a treating operation, such as washing. A spraying system with multiple sprayers can be provided for recirculating liquid throughout the tub to remove soils from the dishes. The dishwasher can be further provided with a door assembly, which can be hingedly mounted to the tub or to the cabinet for pivoting movement about a pivot axis between closed and opened positions to selectively close and open the open front and the access opening.

The dishwasher treats the dish items according to a cycle of operation. A controller is configured to implement the cycle of operation. A user interface is operably coupled with the controller and configured to provide user input to the controller. An electrical power bus is electrically connected to the controller to provide power to the controller from a household power supply.

BRIEF DESCRIPTION

An aspect of the present disclosure relates to a dishwasher comprising a chassis defining an interior, a tub located within the interior and at least partially defining a treating chamber, an electrical power bus having a plug, and a radio frequency interference (RFI) housing having a household power supply connection and an appliance socket, which receives the plug from the electrical power bus and is electrically connected to the household power supply connection.

Another aspect of the present disclosure relates to a dishwasher comprising a chassis defining an interior, a tub located within the interior and at least partially defining a treating chamber, a controller operably coupled to the dishwasher and configured to control operation of the dishwasher according to a cycle of operation, an electrical power bus electrically connected to the controller and having a plug, and a radio frequency interference (RFI) housing having a household power supply connection and an appliance socket, which receives the plug from the electrical power bus and is electrically connected to the household power supply connection.

DETAILED DESCRIPTION

In order to simplify the manufacture of dishwashers, it is helpful to assemble the dishwashers in such a way that allows for case of customization of dishwasher units that will ultimately be shipped to different countries. When manufacturing dishwashers of the same type or product that will ultimately be shipped to and used within a variety of different countries, the different types of power plugs used within the different countries should be taken into account. In some dishwashers, the power cord for the dishwasher that will connect to a household power supply is already installed with the dishwasher during the manufacturing process, which means the power cord cannot easily be switched if the unit is shipped to a country that is not compatible with the power cord used. However, if the appliance is manufactured with an appliance socket that is configured to couple with multiple different household power supply connections, the dishwashers can then be suitable for any destination country, and the appropriate household power supply connection and power cord can more easily be added post-manufacture, when the dishwasher has reached its destination. This allows for simpler manufacture of the dishwashers without requiring different assembly parts corresponding to different destination countries, as the customization can be completed more easily post-manufacture.

Aspects of the present disclosure relate to an appliance socket for coupling with a household power supply connection, for use with a dish treating appliance. The appliance socket and household power supply connection can be provided with a radio frequency interference (RFI) barrier housing of the dish treating appliance. The appliance socket and household power supply connection assembly can be suitable for any manner of applications including that of the household dish treating appliance of FIG. 1, which is illustrated by way of example and not limitation.

Figure 1:
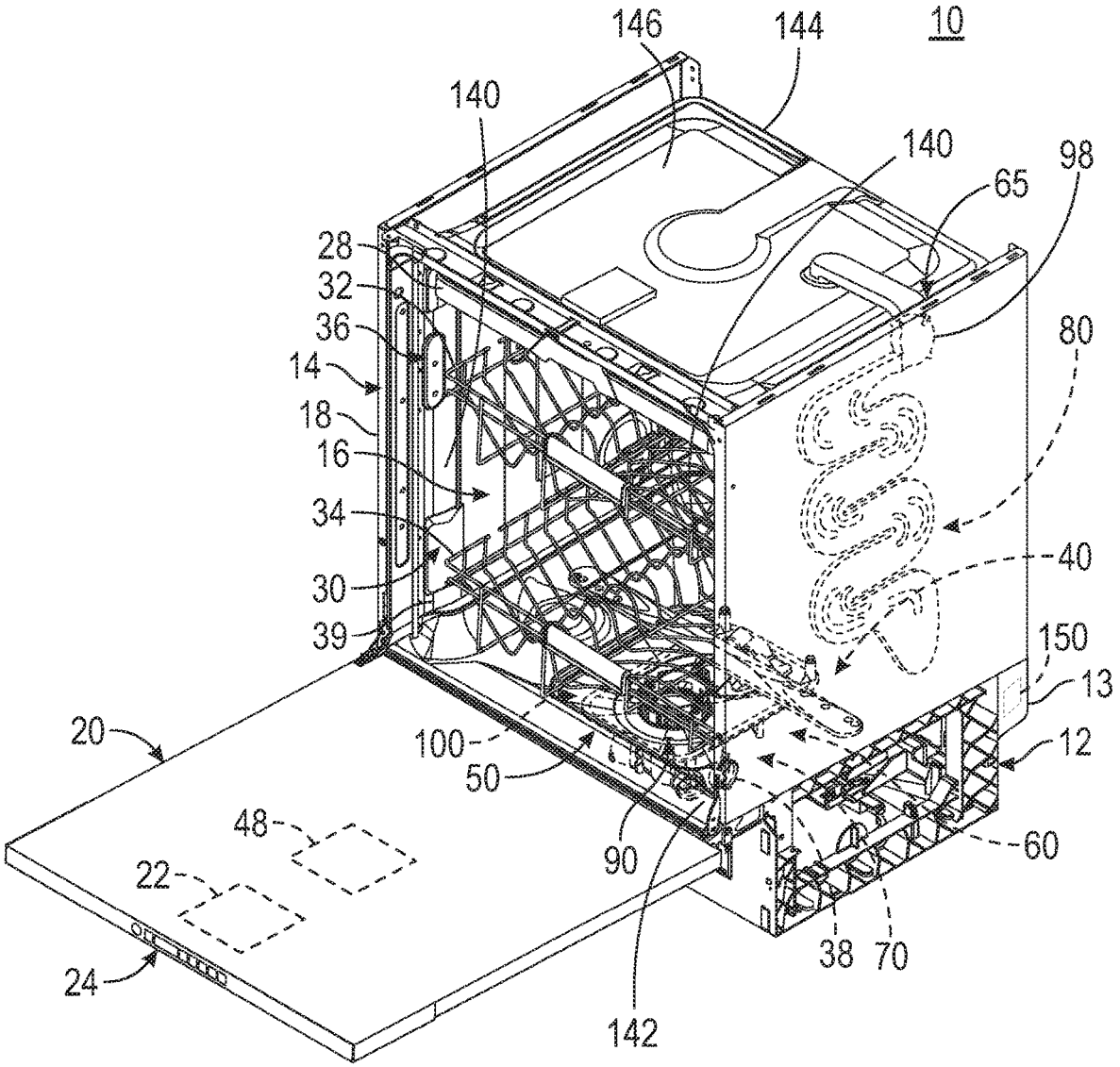
FIG. 1 is a top, front, and right-side perspective view of an automatic dish treating appliance having multiple systems for implementing an automatic cycle of operation.

FIG. 1 illustrates an automatic dish treating appliance 10, illustrated herein as a dishwasher 10, capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, silverware, and other utensils. As illustrated, the dishwasher 10 is a built-in dishwasher 10 implementation, which is designed for mounting under a countertop or other work surface. However, this description is applicable to other dishwasher implementations such as a stand-alone, multi-tub-type, drawer-type, or a sink-type, for example, as well as dishwashers having varying widths, sizes, and capacities. The dishwasher 10 shares many features of a conventional automatic dishwasher, which may not be described in detail herein except as necessary for a complete understanding of aspects of the disclosure.

The dishwasher 10 has a variety of systems, some of which are controllable, to implement the automatic cycle of operation. A chassis or cabinet is provided to support the variety of systems needed to implement the automatic cycle of operation and can define an interior. As illustrated, for a built-in implementation, the chassis or cabinet includes a frame in the form of a base 12 on which is supported an open-faced tub 14. The chassis or cabinet, or specifically the frame or the base 12 includes at least a partial rear wall 13 that at least partially defines an interior of the chassis. The open-faced tub 14 at least partially defines a treating chamber 16, having an access opening, illustrated herein as an open face 18, for receiving the dishes. The open-faced tub 14 can have at least a pair of opposing side walls 140 that are spaced apart from one another, such as by being spaced apart by a bottom wall 142, a rear wall 144, and/or a top wall 146. The pair of opposing side walls 140, the bottom wall 142, the rear wall 144, and the top wall 146 can further be thought of as at least partially defining the treating chamber 16, and optionally also the open face 18 to serve as the access opening.

A closure in the form of a door assembly 20 can be hingedly or pivotally mounted to the base 12, or to any other suitable portion of the cabinet or chassis or of the tub 14, for movement relative to the tub 14 between opened and closed positions to selectively open and close the open face 18 of the tub 14. In one example, the door assembly 20 is mounted for pivoting movement about a pivot axis relative to the base 12, the tub 14, or the open face 18. In the opened position, a user can access the treating chamber 16, as shown in FIG. 1, while, in the closed position (not shown), the door assembly 20 covers or closes the open face 18 of the treating chamber 16. Thus, the door assembly 20 provides selective accessibility to the treating chamber 16 for the loading and unloading of dishes or other items.

The chassis or cabinet, as in the case of the built-in dishwasher implementation, can be formed by other parts of the dishwasher 10, like the tub 14 and the door assembly 20, in addition to a dedicated frame structure, like the base 12, with them all collectively forming a uni-body frame by which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include a dish holding system 30, spray system 40, recirculation system 50, drain system 60, water supply system 70, air supply system 65, heating system 90, filter system 100, and a housing 150 configured to act as a radio frequency interference (RFI) barrier, which can be provided at or with the rear wall 13 of the chassis. These systems are used to implement one or more treating cycles of operation for the dishes, for which there are many, one of which includes a traditional automatic wash cycle.

A basic traditional automatic cycle of operation for the dishwasher 10 has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The amounts of water, treating chemistry, and/or rinse aid used during each of the multiple wash or rinse steps can be varied. The wash phases and rinse phases can include the heating of the water, even to the point of one or more of the phases being hot enough for long enough to sanitize the dishes. A drying phase can follow the rinse phase(s). The drying phase can include a drip dry, a non-heated drying step (so-called "air only"), heated dry, condensing dry, air dry or any combination. These multiple phases or steps can also be performed by the dishwasher 10 in any desired combination.

A controller 22 can also be included in the dishwasher 10 and operably couples with and controls the various components of the dishwasher 10 to implement the cycles of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can provide an input and output function for the controller 22. While the user interface 24 is illustrated in FIG. 1 as being provided on a top surface of the door assembly 20, it will be understood that the user interface 24 can be provided at any suitable location on the door assembly 20, such as on a front surface of the door assembly 20.

The user interface 24 can include operational controls such as one or more knobs, dials, lights, switches, displays, touch screens and the like for communicating with the user, such as enabling a user to input commands, such as a cycle of operation, to the controller 22 and to receive information, for example about the selected cycle of operation. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the dishwasher 10 and can allow the controller 22 to communicate with the user in a variety of ways. For example, the controller 22 can be configured to send a text message to the user, send an electronic mail to the user, or provide audio information to the user either through the dishwasher 10 or utilizing another device such as a mobile phone.

The controller 22 can include the machine controller and any additional controllers provided for controlling any of the components of the dishwasher 10. For example, the controller 22 can include the machine controller and a motor controller. Many known types of controllers can be used for the controller 22. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

The dish holding system 30 can include any suitable structure or structures for receiving or holding dishes within the treating chamber 16. Exemplary dish holders are illustrated in the form of an upper dish rack 32 and lower dish rack 34, commonly referred to as "racks", which are located within the treating chamber 16. The upper dish rack 32 and the lower dish rack 34 each define an interior and are typically mounted for slidable movement in and out of the treating chamber 16 through the open face 18 for ease of loading and unloading. In one example, it is common for the upper dish rack 32 to be slidably mounted within and to the tub 14 by the use of a suitable drawer withdrawal assembly, such as by the use of drawer guides, slides, or rails 36, while the lower dish rack 34 is instead typically provided with wheels or rollers 38 that can roll along a travel path 39 defined by at least a portion of the dishwasher 10. For example, it is typical for the lower dish rack 34 to be slidable along the travel path 39 such that the lower dish rack 34 can roll along the travel path 39 and then continue to roll onto the door assembly 20, when the door assembly 20 is in the opened position and allows for withdrawal of the dish racks 32, 34.

By way of further example, in such a case, it is also typical that the travel path 39 can include a type of rails 39, but that rails 39 for the lower dish rack 34 may differ in structure from the rails 36 for the upper dish rack 32, and in particular such that the rails 39 may be provided simply as a ledge or a surface formed by the tub 14, such as formed or carried by the side walls 140 or the bottom wall 142 of the tub 14. By providing the rails 39 for the lower dish rack 34 as a simpler support surface, such as a ledge, rather than a more restrictive or enclosing structure such as the rails 36, the rails 39 are better able to accommodate movement or instability of the lower dish rack 34 as the lower dish rack 34 rolls onto the door assembly 20, going from the static, stable tub 14 to the movable door assembly 20. In this way, the rails 39 allow more tolerance for movement as the lower dish rack 34 rolls along the door assembly 20.

In addition, dedicated dish holders can also be provided. One such dedicated dish holder is a third level rack 28 located above the upper dish rack 32. Like the upper dish rack 32, the third level rack 28 is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack 28, it can be washed in the third level rack 28. The third level rack 28 generally has a much shorter height or lower profile than the upper and lower dish racks 32, 34. Typically, the height of the third level rack 28 is short enough that a typical glass cannot be stood vertically in the third level rack 28 and the third level rack 28 still be slid into the treating chamber 16.

Another dedicated dish holder can be a utensil or silverware basket (not shown), which is typically located in the treating chamber 16 and carried by one of the upper or lower dish racks 32, 34 or mounted to the door assembly 20. The silverware basket typically holds utensils and the like in an upright orientation as compared to the on-the-side or flat orientation of the third level rack 28. More than one silverware basket can be provided with the dishwasher 10.

A dispenser assembly 48 is provided to store and dispense treating chemistry, e.g. detergent, anti-spotting agent, etc., into the treating chamber 16. The dispenser assembly 48 can be mounted on an inner surface of the door assembly 20, as shown, or can be located at other positions within the chassis or treating chamber 16, such that the dispenser assembly 48 is positioned to be accessed by the user for refilling of the dispenser assembly 48, whether it is necessary to refill the dispenser assembly 48 before each cycle (i.e. for a single use dispenser) or only periodically (i.e. for a bulk dispenser). The dispenser assembly 48 can dispense one or more types of treating chemistries. The dispenser assembly 48 can be a single-use dispenser, which holds a single dose of treating chemistry, or a bulk dispenser, which holds a bulk supply of treating chemistry and which is adapted to dispense a dose of treating chemistry from the bulk supply during the cycle of operation, or a combination of both a single use and bulk dispenser. The dispenser assembly 48 can further be configured to hold multiple different treating chemistries. For example, the dispenser assembly 48 can have multiple compartments defining different chambers in which treating chemistries can be held.

Figure 2:
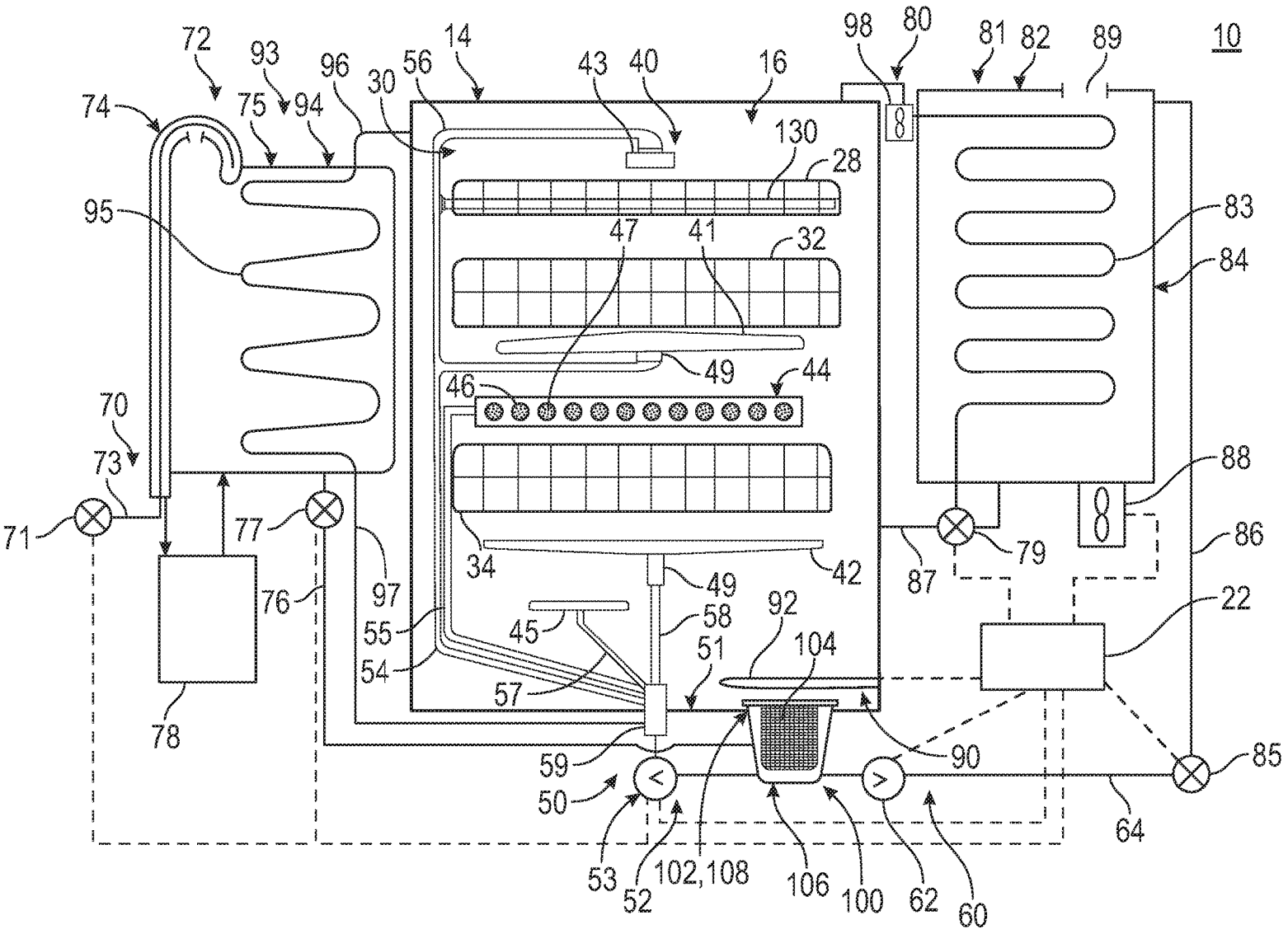
FIG. 2 is a schematic view of the dish treating appliance of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers 41, 42, 43, 44, 45, 130, some of which can be dedicated to a particular one of the dish holders, to particular area of a dish holder, to a particular type of cleaning, or to a particular level of cleaning, etc. The sprayers 41, 42, 43, 44, 45, 130 can be fixed or movable, such as rotating, relative to the treating chamber 16 or dish holder. Exemplary sprayers 41, 42, 43, 44, 45, 130 are illustrated and include an upper spray arm 41, a lower spray arm 42, a third level sprayer 43, a deep-clean sprayer 44, and a spot sprayer 45. The upper spray arm 41 and lower spray arm 42 can be rotating spray arms, located below the upper dish rack 32 and lower dish rack 34, respectively, and rotate about a generally centrally located and vertical axis. In one non-limiting example, at least one drive assembly, illustrated herein as at least one motor 49, is operably coupled to one of or to each of the upper spray arm 41 and the lower spray arm 42 in order to control and drive rotation of the lower spray arm 42. The third level sprayer 43 is located above the third level rack 28. The third level sprayer 43 is illustrated as being fixed, but could move, such as in rotating. In addition to the third level sprayer 43 or in place of the third level sprayer 43, a sprayer 130 can be located at least in part below a portion of the third level rack 28, though it will be understood that such a sprayer 130 can be provided adjacent any of the racks 28, 32, 34. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or can move, such as by way of rotating. The spray emitted by the deep-clean sprayer 44 defines a deep clean zone, which, as illustrated, would extend along a rear side of the lower dish rack 34. Thus, dishes needing deep cleaning, such as dishes with baked-on food, can be positioned in the lower dish rack 34 to face the deep-clean sprayer 44. The deep-clean sprayer 44, while illustrated as only one unit on a rear wall of the tub 14, could comprise multiple units and/or extend along multiple portions, including different walls, of the tub 14, and can be provided above, below, or beside any of the dish holders 28, 32, 34 wherein deep cleaning is desired.

The spot sprayer 45, like the deep-clean sprayer 44, can emit an intensified and/or higher pressure spray, especially to a discrete location within one of the dish holders 28, 32, 34. While the spot sprayer 45 is shown below the lower dish rack 34, it could be adjacent any part of any dish holder 28, 32, 34 or along any wall of the tub 14 where special cleaning is desired. In the illustrated location below the lower dish rack 34, the spot sprayer 45 can be used independently of or in combination with the lower spray arm 42. The spot sprayer 45 can be fixed or can move, such as in rotating.

These sprayers 41, 42, 43, 44, 45, 130 are illustrative examples of suitable sprayers and are not meant to be limiting as to the type of suitable sprayers 41, 42, 43, 44, 45, 130. Additionally, it will be understood that not all of the exemplary sprayers 41, 42, 43, 44, 45, 130 need be included within the dishwasher 10, and that less than all of the sprayers 41, 42, 43, 44, 45, 130 described can be included in a suitable dishwasher 10.

The recirculation system 50 recirculates the liquid sprayed into the treating chamber 16 by the sprayers 41, 42, 43, 44, 45, 130 of the spray system 40 back to the sprayers 41, 42, 43, 44, 45, 130 to form a recirculation loop or circuit by which liquid can be repeatedly and/or continuously sprayed onto dishes in the dish holders 28, 32, 34. The recirculation system 50 can include a sump 51 and a pump assembly 52. The sump 51 collects the liquid sprayed in the treating chamber 16 and can be formed by a sloped or recess portion of the bottom wall 142 of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 41, 42, 43, 44, 45, 130 to the recirculation pump 53. A recirculation valve 59 can selectively fluidly couple each of the conduits 54, 55, 56, 57, 58 to the recirculation pump 53. While each sprayer 41, 42, 43, 44, 45, 130 is illustrated as having a corresponding dedicated supply conduit 54, 55, 56, 57, 58, one or more subsets, comprising multiple sprayers from the total group of sprayers 41, 42, 43, 44, 45, 130, can be supplied by the same conduit, negating the need for a dedicated conduit 54, 55, 56, 57, 58 for each sprayer 41, 42, 43, 44, 45, 130. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54, 55, 56, 57, 58 can be directly coupled to the recirculation pump 53, while one or more of the other conduits 54, 55, 56, 57, 58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupling the treating chamber 16 to a drain line 64. As illustrated, the drain pump 62 fluidly couples the sump 51 to the drain line 64.

While separate recirculation 53 and drain pumps 62 are illustrated, a single pump can be used to perform both the recirculating and the draining functions, such as by configuring the single pump to rotate in opposite directions, or by providing a suitable valve system. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to at least some extent.

A water supply system 70 is provided for supplying fresh water to the dishwasher 10 from a water supply source, such as a household water supply via a household water valve 71. The water supply system 70 includes a water supply unit 72 having a water supply conduit 73 with a siphon break 74 or an air break 74. While the water supply conduit 73 can be directly fluidly coupled to the tub 14 or any other portion of the dishwasher 10, the water supply conduit 73 is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 can be provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

An air supply system 65 is provided to aid in the treating of the dishes during the cycle of operation by supplying air to at least a portion of the dishwasher 10, a non-limiting example of which includes the treating chamber 16. The air supply system 65 can include a variety of assemblies, pathways, and circuits for supplying air to different portions of the dishwasher 10 and for different purposes within the dishwasher 10, such that the air supply system 65 can be thought of as comprising all of the air supplying or air circulating portions of the dishwasher 10. In one non-limiting example, the air supply system 65 comprises a drying system 80 that is provided to aid in the drying of the dishes during the drying phase. The drying system 80 as illustrated, by way of non-limiting example, includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber 16, or a combination of both by operating in one configuration and then the other configuration. A fan or blower 98 can be fluidly coupled with the serpentine conduit 83 to move air through the serpentine conduit 83. It will also be understood that the serpentine conduit 83 is not limited to having a serpentine shape and can instead be provided with any suitable size and shape.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60, or water supply system 70, such that liquid can be supplied to the cooling tank 84. The liquid provided to the cooling tank 84 from any of the systems 40, 50, 60, 70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected based on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater 92, located in the treating chamber 16 at a location where it will be immersed by the water supplied to the treating chamber 16, such as within or near the sump 51. However, it will also be understood that the heater 92 need not be an immersion heater 92; it can also be an in-line heater located in any of the conduits. There can also be more than one heater 92, including both an immersion heater 92 and an in-line heater. The heater 92 can also heat air contained in the treating chamber 16. Alternatively, a separate heating element (not shown) can be provided for heating the air circulated through the treating chamber 16.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated, such as an ultrafiltration system.

Figure 3:
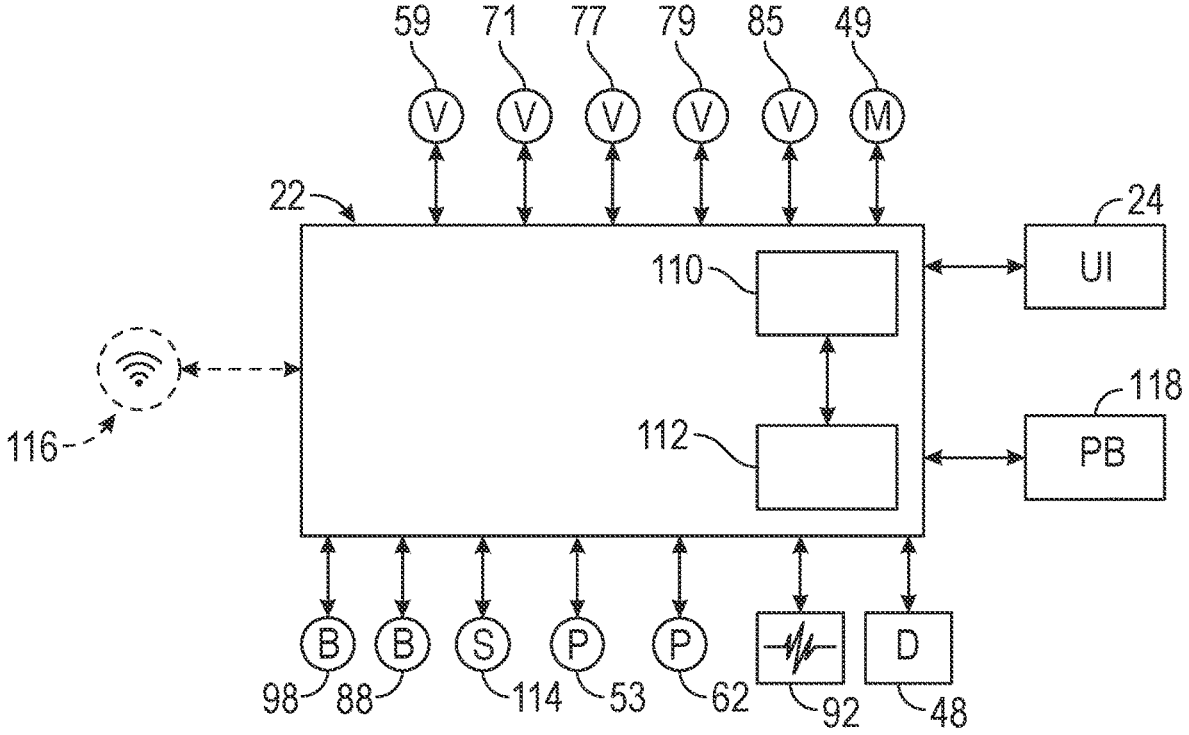
FIG. 3 is a schematic view of a controller of the dish treating appliance of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, the recirculation pump 53 for recirculating the wash liquid during the cycle of operation, the user interface 24 for receiving user selected inputs and communicating information to the user, the dispenser assembly 48 for selectively dispensing treating chemistry to the treating chamber 16, the at least one motor 49 for selectively actuating rotation of the upper spray arm 41 and/or the lower spray arm 42, the blower 98 for providing air through the serpentine conduit 83, and the blower 88 for providing air into the cooling tank 84. The controller 22 can also communicate with the recirculation valve 59, the household water valve 71, the controllable valve 77, the return valve 79, and the valve 85 to selectively control the flow of liquid within the dishwasher 10. Optionally, the controller 22 can include or communicate with a wireless communication device 116. The controller 22 is also operably and electrically coupled with a central power wire or wiring harness, provided as an electrical power bus 118, that is configured to couple with a household power supply to supply power to the dishwasher 10.

The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store a set of executable instructions including one or more pre-programmed automatic cycles of operation that can be selected by a user and executed by the dishwasher 10. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 24. The memory 110 can also be used to store information, such as a database or table, and to store data received from one or more components of the dishwasher 10 that can be communicably coupled with the controller 22. The database or table can be used to store the various operating parameters for the one or more cycles of operation, including factory default values for the operating parameters and any adjustments to them by the control assembly or by user input.

The controller 22 can also receive input from one or more sensors 114 provided in one or more of the assemblies or systems of the dishwasher 10 to receive input from the sensors 114, which are known in the art and not shown for simplicity. Non-limiting examples of sensors 114 that can be communicably coupled with the controller 22 include, to name a few, an ambient air temperature sensor, a treating chamber temperature sensor, such as a thermistor, a water supply temperature sensor, a door open/close sensor, a moisture sensor, a chemical sensor, and a turbidity sensor to determine the soil load associated with a selected grouping of dishes, such as the dishes associated with a particular area of the treating chamber 16.

Figure 4:
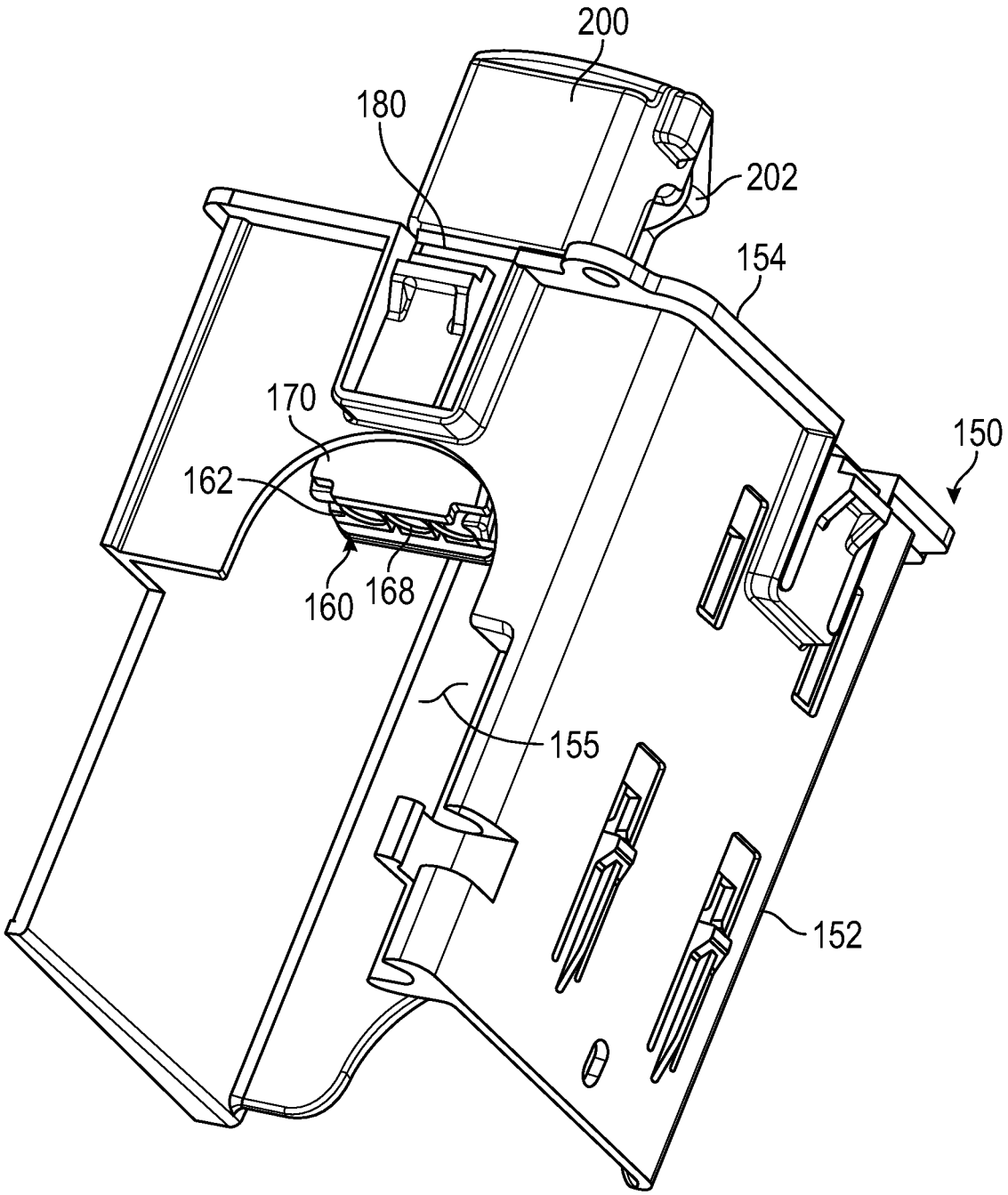
FIG. 4 illustrates a front perspective view of a housing having a household power supply connection and an appliance socket, with the household power supply connection coupled with a plug, according to an aspect of the present disclosure and for use with the dish treating appliance of FIGS. 1-3.

Turning now to FIG. 4, a rear perspective view of an example of the housing 150 for use within the dishwasher 10 is illustrated. The housing 150 comprises a housing body 152 and a rear wall 154 at least partially defining a housing interior 155, the housing body 152 extending from the rear wall 154. When the housing 150 is assembled within the interior of the dishwasher 10, the rear wall 154 is provided at, on, or forms a part of the rear wall 13 of the chassis, such that the housing body 152 projects from the rear walls 13, 154 and into the interior of the chassis. By way of non-limiting example, the housing 150, and specifically the rear wall 154, can be coupled with the rear wall 13 of the chassis by any suitable mechanical coupling, connector, or fastener, or the rear wall 154 of the housing 150 can be integrally or unitarily formed with the rear wall 13 of the chassis. The housing 150, including the housing body 152 and the rear wall 154, can have a structure and/or can be formed of a suitable material for allowing the housing 150 to act as a radio frequency interference barrier housing 150 for the housing interior 155. The housing 150 can also at least partially form a water barrier about the housing interior 155.

The housing 150 includes or carries an appliance socket 160 that is configured to electrically couple with the controller 22 via the electrical power bus 118. The appliance socket 160 is provided at least partially within the housing interior 155 and defines an appliance socket body 162 having a top wall 170. The appliance socket body 162 at least partially defines an appliance socket end 168 that is configured to receive a plug from the electrical power bus 118 to electrically couple the appliance socket 160 with the electrical power bus 118, and therefore also with the controller 22. By way of non-limiting example, the appliance socket 160 is coupled with the housing 150 at the rear wall 154, such that the appliance socket body 162 at least partially extends into the housing interior 155 and is located on an interior side of the rear wall 154 and of the rear wall 13 of the chassis.

The housing 150 further includes or carries a household power supply connection 180 that is configured to electrically couple with the appliance socket 160 and with a household power supply. Thus, the household power supply connection 180 is further electrically coupled with the electrical power bus 118 and the controller 22 via the electrical connection to the appliance socket 160. The household power supply connection 180 at least partially extends into the appliance socket 160 so as to plug into the appliance socket 160 to electrically couple with the appliance socket 160. By way of non-limiting example, the household power supply connection 180 is coupled, such as by being removably coupled, with the appliance socket 160 at the rear wall 154, such that the household power supply connection 180 partially extends into the appliance socket 160, but is substantially or at least partially still located on an exterior side of the rear wall 154 and of the rear wall 13 of the chassis. A plug 200 from a household power supply cord 202 can selectively couple with the household power supply connection 180 at the exterior side of the rear walls 13, 154.

Figure 5:
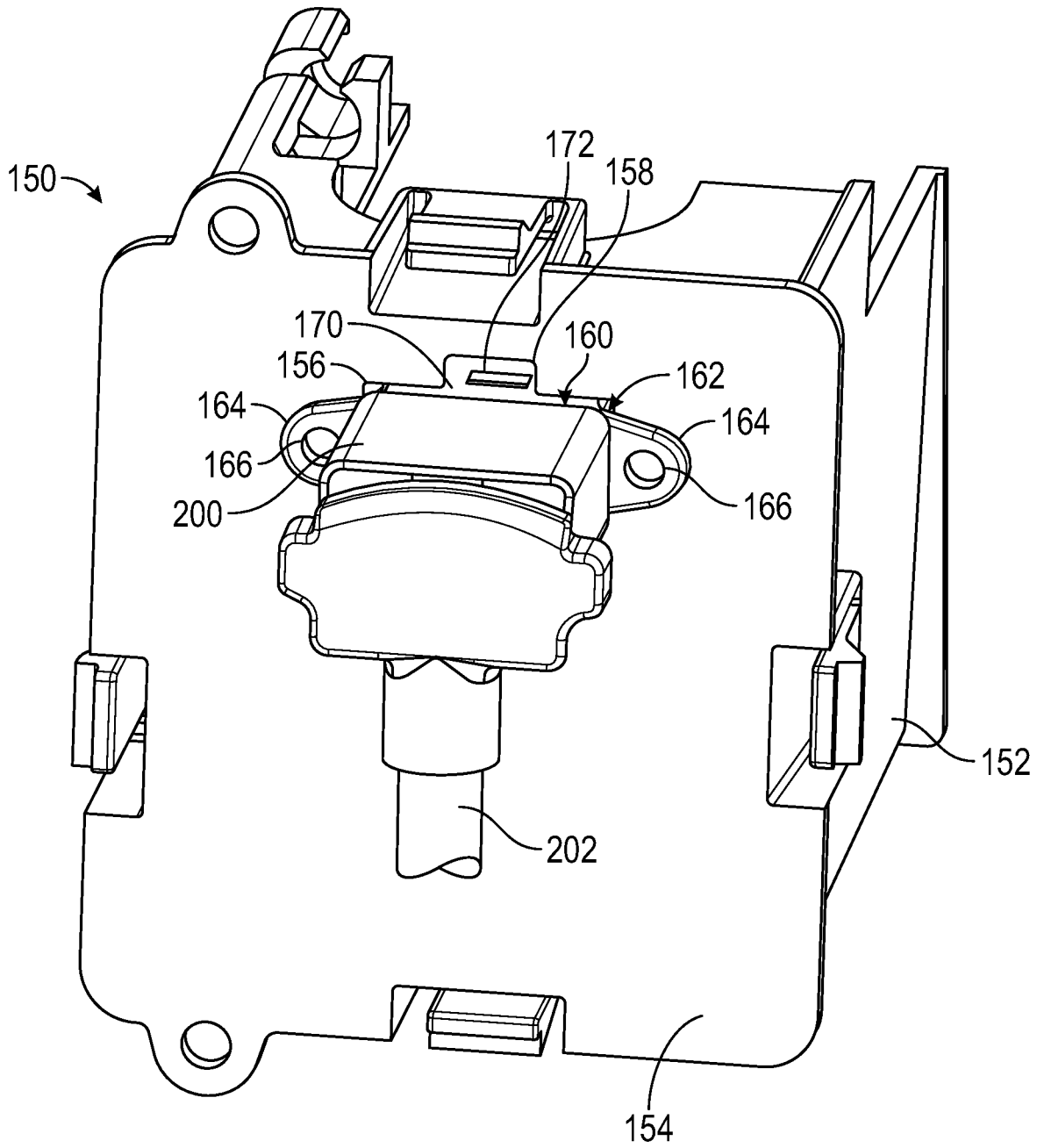
FIG. 5 illustrates a rear perspective view of the housing, the household power supply connection coupled with the plug, and the appliance socket of FIG. 4.

Turning now to FIG. 5, the coupling of the appliance socket 160 with the housing 150, and particularly the rear wall 154, is shown in greater detail. The rear wall 154 defines an opening 156 through which a portion of the appliance socket 160 extends, the opening 156 additionally defining an access notch 158 along at least a portion of the top wall 170 of the appliance socket 160. Through the access notch 158, it can also be seen that the top wall 170 of the appliance socket 160 includes a latch opening 172. In the illustrated example, the appliance socket 160 is mechanically fastened to the rear wall 154. Specifically, the appliance socket 160 includes at least one fastening flange 164, illustrated herein as a pair of opposing fastening flanges 164 each defining a fastener opening 166 through which a mechanical fastener (not shown), such as a screw, a bolt, or a heat stake, can extend to secure the appliance socket 160 to the rear wall 154 and to the housing 150. Alternatively, it will be understood that the appliance socket 160 can instead be integrally or unitarily formed with the housing 150, such as with the rear wall 154, rather than being coupled via mechanical fastening means.

Figure 6:
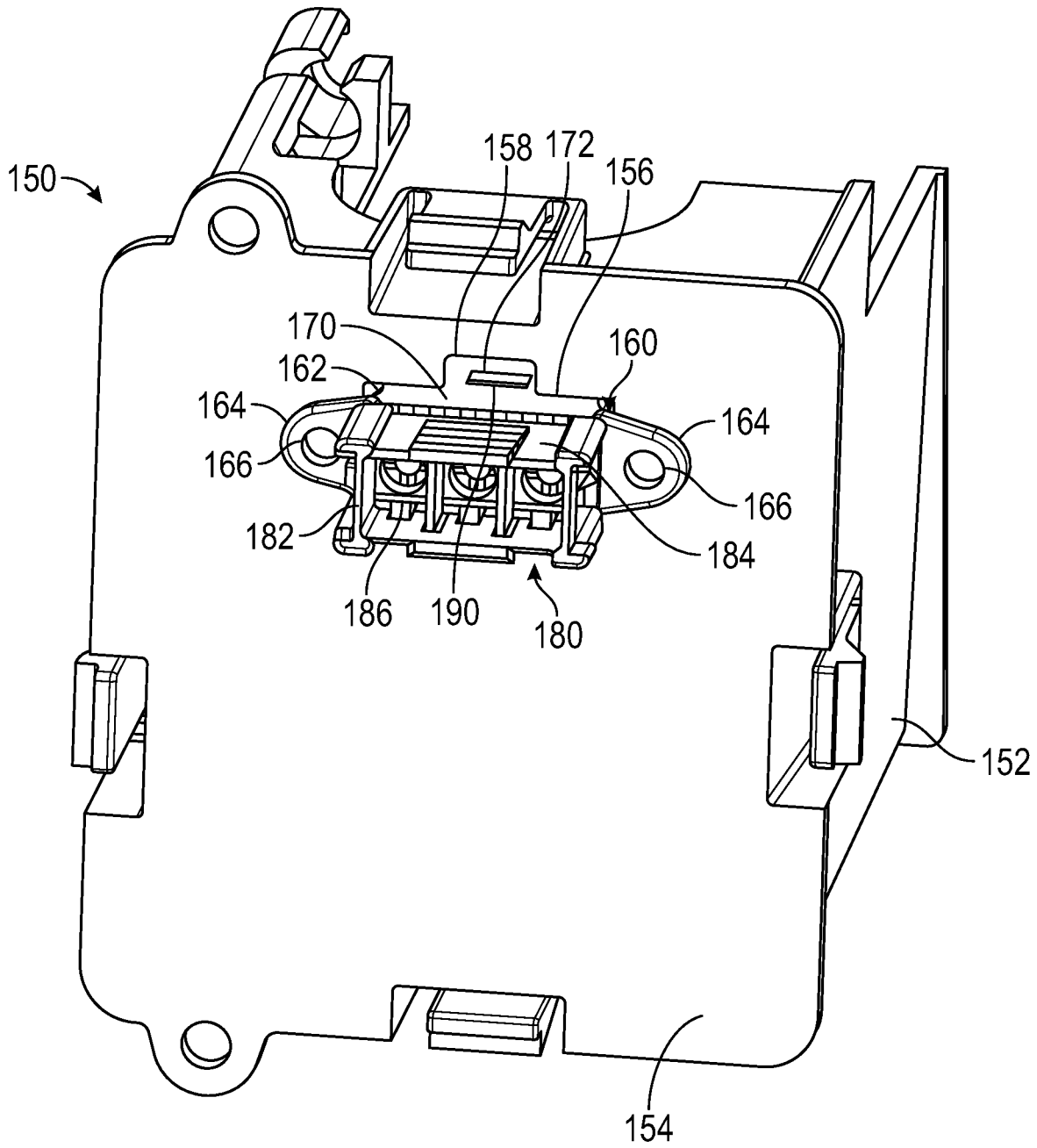
FIG. 6 illustrates the rear perspective view of FIG. 4, showing the housing, the household power supply connection, and the appliance socket, but with the plug removed.

Turning now to FIG. 6, the view of FIG. 5 is shown, but with the plug 200 and household power supply cord 202 removed from the household power supply connection 180 to more clearly illustrate the household power supply connection 180. The household power supply connection 180 defines a connector body 182 having a top wall 184. The top wall 184 at least partially defines a deflectable catch 190 that is received within the latch opening 172 of the top wall 170 of the appliance socket 160 when the household power supply connection 180 is coupled with the appliance socket 160. The household power supply connection 180 further at least partially defines a power cord socket 186 that is configured to receive the plug 200 from the household power supply cord 202 to electrically couple the household power supply connection 180 with the household power supply, and therefore also to couple the controller 22 and the dishwasher 10 with the household power supply via the electrical power bus 118. While the household power supply connection 180 is illustrated herein as being removably couplable with the household power supply cord 202 via the plug 200 and the power cord socket 186, it will be understood that the household power supply connection 180 could alternately comprise a hardwired electrical connection with the household power supply cord 202.

Figure 7:
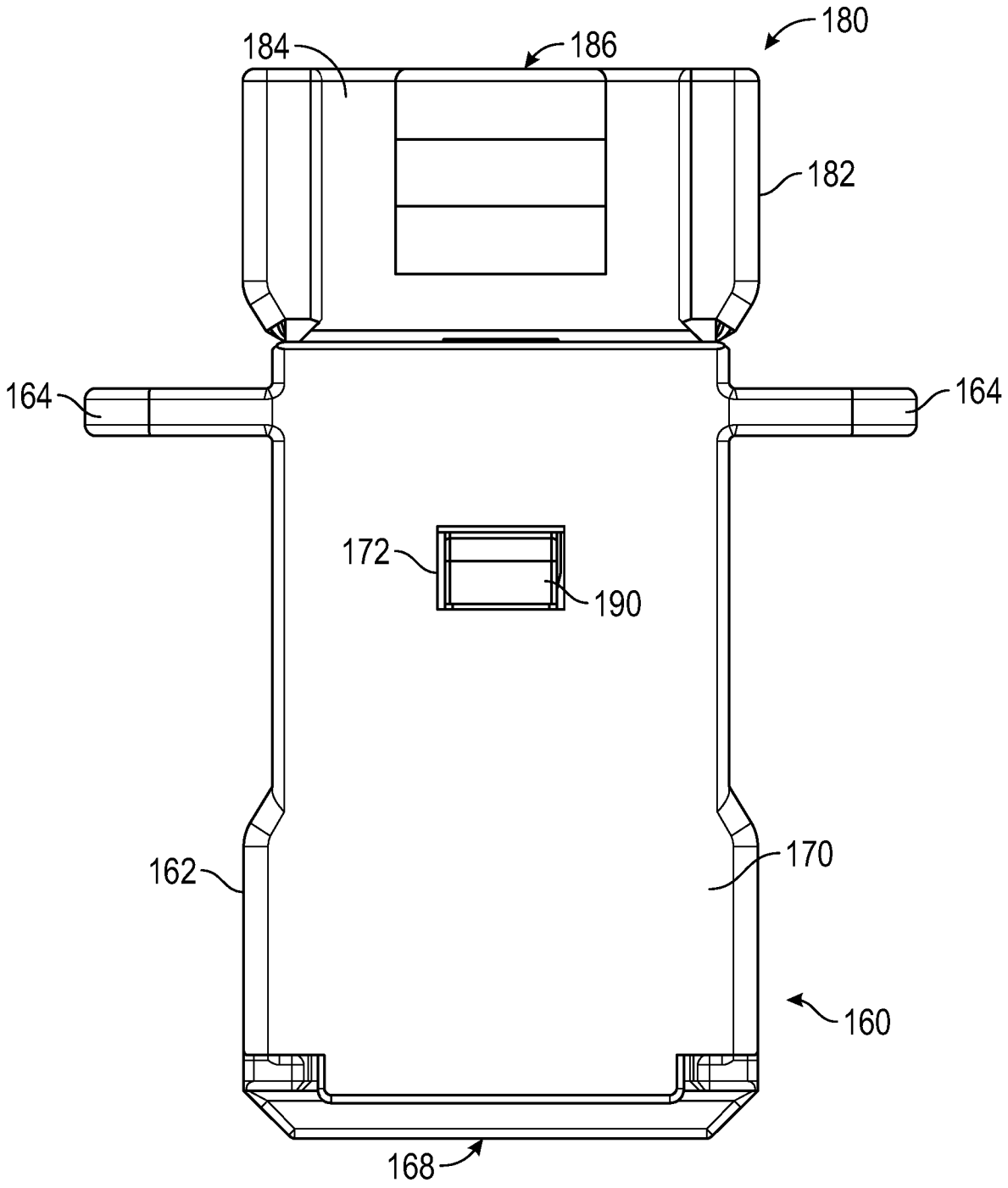
FIG. 7 illustrates a top view of the household power supply connection coupled with the appliance socket of FIG. 6, and with the housing removed.

Turning now to FIG. 7, a top view of the household power supply connection 180 coupled with the appliance socket 160, and with the housing 150 removed, shows the interaction between the deflectable catch 190 and the latch opening 172 in greater detail. When the household power supply connection 180 is being coupled with the appliance socket 160, as the portion of the household power supply connection 180 is slid partially into the appliance socket 160, the top wall 170 of the appliance socket 160 downwardly deflects the deflectable catch 190 until the household power supply connection 180 is inserted into the appliance socket 160 to the extent that the deflectable catch 190 is aligned with the latch opening 172, at which point the deflectable catch 190 is biased upwardly into the latch opening 172 to retain the household power supply connection 180 in the coupled state with the appliance socket 160, such as by a snap-fit coupling of the deflectable catch 190 and the latch opening 172. Thus, the deflectable catch 190 and the latch opening 172 can be thought of as collectively defining a latch mechanism that removably couples the household power supply connection 180 to the appliance socket 160. In order to remove the household power supply connection 180 from the appliance socket 160, a tool can be inserted through the access notch 158 in the rear wall 154 to apply downward pressure on the deflectable catch 190 in order to disengage the deflectable catch 190 from the latch opening 172, and therefore to allow removal of the household power supply connection 180 from the appliance socket 160. Thus, the deflectable catch 190 and the latch opening 172 can be further thought of as collectively defining a tool-removable latch mechanism removably coupling the household power supply connection 180 to the appliance socket 160.

The simple coupling and latch mechanism between the household power supply connection 180 and the appliance socket 160 allow for the coupling of different household power supply connections 180 with the appliance socket 160, which provides for customizability to accommodate various household power supply cords 202 for use of the dishwasher 10 in various countries, such as by accommodating household power supply cords 202 having differing current or voltage ratings. Additionally, or alternatively, the household power supply connection 180 can remain coupled with the appliance socket 160 and can instead accommodate different versions of the power cord socket 186 comprising differing keying patterns so as to be configured to electrically couple with more than one type of household power supply cords 202, such as by accommodating household power supply cords 202 having differing current or voltage ratings.

Further, as illustrated in the top view of FIG. 7, it can be seen that the fastening flanges 164 are provided vertically extending from the appliance socket body 162, such that the appliance socket 160 and the household power supply connection 180 extend orthogonally relative to the rear wall 154, to extend substantially horizontally when the rear wall 154 is oriented vertically. However, it will be understood that the fastening flanges 164 could instead extend from the appliance socket body 162 in such a way that the fastening flanges 164 are angled from the bottom to the top of the fastening flanges 164. In this case, the appliance socket 160 and the household power supply connection 180 would then extend at oblique angles relative to the rear wall 154. By way of non-limiting example, such oblique angles can include the appliance socket 160 and the household power supply connection 180 angling downwardly from the housing interior 155 to an exterior side of the rear wall 154 when the rear wall 154 is oriented vertically, so as to allow for water management and to direct the flow of any liquid that may reach the housing 150 in a desired direction.

The aspects of the present disclosure described herein set forth an assembly of an RFI barrier housing, an appliance socket, and a household power supply connection that can be used to simplify manufacturing processes and to allow greater flexibility for use of the manufactured dishwashers in a variety of countries and with a variety of types of household power supply cords that can be customized post-manufacture, depending on where the dishwasher is implemented. By allowing this flexibility after manufacturing, rather than during the manufacturing process, the same appliance socket footprint can be leveraged across all machines of a model type, regardless of plug type they will need to be used with, reducing manufacturing costs and complexity. Such an assembly also allows for the household power supply connection to be easily changed when needed without significant dis-assembly of the dishwasher, allowing the cord to become an accessory, rather than an assembled part during manufacture. Further, providing such an assembly in conjunction with the RFI barrier housing allows for better protection of the plug elements against liquid exposure, and can be employed with minimal changes to the existing RFI barrier housing part structure.

It will also be understood that various changes and/or modifications can be made without departing from the spirit of the present disclosure. By way of non-limiting example, although the present disclosure is described for use with a dishwasher, it will be recognized that the RFI barrier housing, appliance socket, and household power supply connection can be employed with various other types of household appliances, as well.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher, comprising:

a chassis defining an interior;

a tub located within the interior and at least partially defining a treating chamber;

an electrical power bus having a plug; and a radio frequency interference (RFI) housing having a removable household power supply connection and an appliance socket configured to receive the plug from the electrical power bus and is electrically connected to the removable household power supply connection and a latch mechanism configured to couple the removable household power supply connection or an alternative removable household power supply connection to the appliance socket.

2. The dishwasher of claim 1 wherein the removable household power supply connection comprises a power cord socket configured to receive a plug from a household power supply cord.

3. The dishwasher of claim 1 wherein the appliance socket further comprises a mechanical fastener for securing to the RFI housing.

4. The dishwasher of claim 1 wherein the appliance socket is integrally formed with the RFI housing.

5. The dishwasher of claim 1, wherein the latch mechanism is a snap-fit coupling between the removable household power supply connection and the appliance socket.

6. The dishwasher of claim 1 wherein the latch mechanism comprises a tool-removable latch mechanism.

7. The dishwasher of claim 1 wherein the RFI housing is located within the interior on a rear wall of the chassis, such that the RFI housing projects from the chassis into the interior.

8. The dishwasher of claim 7 wherein the appliance socket is located on an interior side of the rear wall.

9. The dishwasher of claim 8 wherein the removable household power supply connection is located on an exterior side of the rear wall.

10. The dishwasher of claim 1 wherein the removable household power supply connection comprises keying configured to electrically couple with more than one type of household power supply cord.

11. The dishwasher of claim 10 wherein the more than one type of household power supply cord comprises household power supply cords having differing current or voltage ratings.

12. The dishwasher of claim 1 wherein the removable household power supply connection and the appliance socket project from the RFI housing at oblique angles relative to the RFI housing.

13. A dishwasher, comprising:

a chassis defining an interior;

a tub located within the interior and at least partially defining a treating chamber;

a controller operably coupled to the dishwasher and configured to control operation of the dishwasher according to a cycle of operation;

an electrical power bus electrically connected to the controller and having a plug; and a radio frequency interference (RFI) housing having a household power supply connection and an appliance socket configured to receive the plug from the electrical power bus, wherein at least one of a latch or a catch is provided on the appliance socket and wherein the other of the latch or the catch is provided on the household power supply connection, wherein the household power supply connection is removably couplable to the appliance socket and wherein when the household power supply connection is coupled to the appliance socket, the household power supply connection is electrically connected to the appliance socket and the household power supply connection coupling to the appliance socket is retained via interfacing of the catch and the latch.

14. The dishwasher of claim 13 wherein the appliance socket is configured to electrically couple the controller with the household power supply connection.

15. The dishwasher of claim 13 wherein the catch and the latch form a latch mechanism comprising a tool-removable latch mechanism.

16. A dishwasher, comprising:

a chassis defining an interior;

a tub located within the interior and at least partially defining a treating chamber;

an electrical power bus having a plug; and a radio frequency interference (RFI) housing having a household power supply connection and an appliance socket configured to receive the plug from the electrical power bus and wherein at least one of a latch or a catch is provided on the appliance socket and wherein the other of the latch or the catch is provided on the household power supply connection, wherein the household power supply connection is removably couplable to the appliance socket and wherein when the household power supply connection is coupled to the appliance socket, the household power supply connection is electrically connected to the appliance socket and the household power supply connection coupling to the appliance socket is retained via interfacing of the catch and the latch.

17. The dishwasher of claim 16 wherein the appliance socket is further configured to receive an alternative household power supply connection having the other of a second latch or a second catch and configured to interface with the at least one of the latch or the catch provided with the appliance socket.

18. The dishwasher of claim 16 wherein the household power supply connection comprises a power cord socket configured to receive a plug from a household power supply cord.

19. The dishwasher of claim 16 wherein the catch and the latch form a snap-fit coupling between the household power supply connection and the appliance socket.

20. The dishwasher of claim 16 wherein the household power supply connection comprises keying configured to electrically couple with more than one type of household power supply cord.

* * * * *